US005532439A

United States Patent [19]

Minkin

[11] Patent Number: 5,532,439

[45] Date of Patent: Jul. 2, 1996

[54] SILENCER ASSEMBLY WITH ACOUSTICAL MODULES THEREIN

[75] Inventor: Yuriy Minkin, Buffalo Grove, Ill.

[73] Assignee: Transco Products Inc., Chicago, Ill.

[21] Appl. No.: 264,854

[22] Filed: Jun. 23, 1994

[51] Int. Cl.[6] ..... E04F 17/04

[52] U.S. Cl. ..... 181/224; 181/252; 181/255

[58] Field of Search ..... 181/224, 249, 181/251, 252, 255, 256, 257, 268, 269, 272, 275, 282

[56] References Cited

U.S. PATENT DOCUMENTS 2,994,401 8/1961 Bourne et al. ..... 181/224

4,127,183 11/1978 McLarty ..... 181/224

4,236,597 12/1980 Kiss et al. ..... 181/224

*Primary Examiner*—Khanh Dang

*Attorney, Agent, or Firm*—Wallenstein & Wagner, Ltd.

[57] ABSTRACT

A silencer assembly is disclosed having at least one expansion section (20,30), tapering outwardly along the length thereof, and a silencing section (40) including a transversing bank of a plurality of parallel acoustical modules (60). Each module (60) has side walls (67) and a front and rear framing member (63,64) with a plurality of longitudinal perforated (74) internal channel member (70) surrounded by an acoustical media (80) therein.

16 Claims, 3 Drawing Sheets

SILENCER ASSEMBLY WITH ACOUSTICAL MODULES THEREIN

TECHNICAL FIELD

The present invention relates to apparatuses for muffling and for controlling the pressure loss related to the output of engines, and more particularly, to an improved silencing assembly used in power plants that incorporates unique acoustical modules therein.

BACKGROUND OF THE INVENTION

Common applications of silencer assemblies include gas turbine's intakes and exhausts, system bypasses and system stacks, and fresh air intakes to fans and fan discharges. For example, in power plants the energy is generated by a plurality of combustion turbines that release hot gas at very high noise levels. In many such systems, the hot gas (air) passes through a silencing system. Conventional silencing systems typically utilize a baffle configuration including parallel and spaced baffles, vertically positioned within the ducts or stacks. The baffles generally consist of smooth, perforated metal facings over absorptive elements arranged parallel to the flow passages. Specifically, the active length of the baffle face runs directionally with the gas flow. The baffles are used to split the gas flow into smaller chambers, often called air passages.

The baffles can be flat or concentric rings. The dimensions of the air passages (in the direction of the flow), coupled with the baffle thickness, baffle material, baffle active length, and duct casing configuration are the primary factors that contribute to the system pressure loss through the system and the acoustical performance, namely silencing. These conventional systems generally require flow distribution grids and/or turning vanes to ensure even distribution of the gasses through the air passages for reducing the pressure losses, enhancing the acoustical performance and providing the even distribution of the gas flow to the heat recovery steam generator.

In an effort to increase performance and the benefits of such silencing systems, it is desirous to eliminate the numerous flow distribution devices, to decrease the pressure loss through the system, to improve the acoustical silencing effect of the system, and to simplify the field installation process.

SUMMARY OF THE INVENTION

The present invention increases and improves performance levels and earlier achieved benefits. According to a first aspect of the present invention, a silencer assembly is interposed between two components of the system, such as between the outlet for exhaust gas of a first piece of machinery, i.e., a combustion turbine/generator, and the inlet of a second piece of machinery, i.e., a boiler or exhaust stack to the atmosphere. The silencer assembly includes external side walls with an inlet having a first cross sectional area connected to the outlet for gas of the first piece of machinery and an outlet connected to the inlet of the second piece of machinery. A first section is situated adjacent the assembly's inlet that has an expanding cross sectional area along the length thereof. There may also be a second section adjacent the first section that has an expanding cross sectional area along the length thereof. Disposed between the second section and the assembly's outlet, there is a third section that has disposed therein at least one transversing bank comprised of a plurality of parallel, box-like rectangular acoustical modules. These modules replace the turning vanes, flow distribution grids and conventional baffles found in the prior art and previous devices. They are self-contained and self-supporting; they may be easily stacked atop each other eliminating field rigging.

According to another aspect of the present invention, the external side walls of the assembly may be equipped for further attenuation. In such cases, the external walls are comprised of a solid outer casing and an internal heat shield liner (in cases of high temperatures) with an acoustical media disposed therebetween.

According to still another aspect of the present invention, each acoustical module has a front end and a rear end and a plurality of parallel internal channel members therein. Each internal channel member has a plurality of perforations therein and a front opening at the front end of the module and a rear opening at the rear end of the module. In addition, the front openings and the rear openings of the internal channels are connected to a front and rear framing member, respectively, with a separate mouth therein adjacent each internal channel and a throat tapering inwardly towards the internal channel. Each acoustical module also has encasing side walls and an internal intermediate support wall disposed between and parallel to the framing members with openings therein for permitting the internal channel members to pass therethrough and for further sound attenuation. Further, the internal channel members in the module are surrounded by an acoustical media.

Other advantages and aspects of the present invention will become apparent upon reading the following description of the drawings and detailed description of the invention.

BRIEF DESCRIPTION OF THE DRAWINGS

In order that the present invention may be more fully understood, it will now be described by way of example, with reference to the accompanying drawings in which.

DETAILED DESCRIPTION

Figure 2:
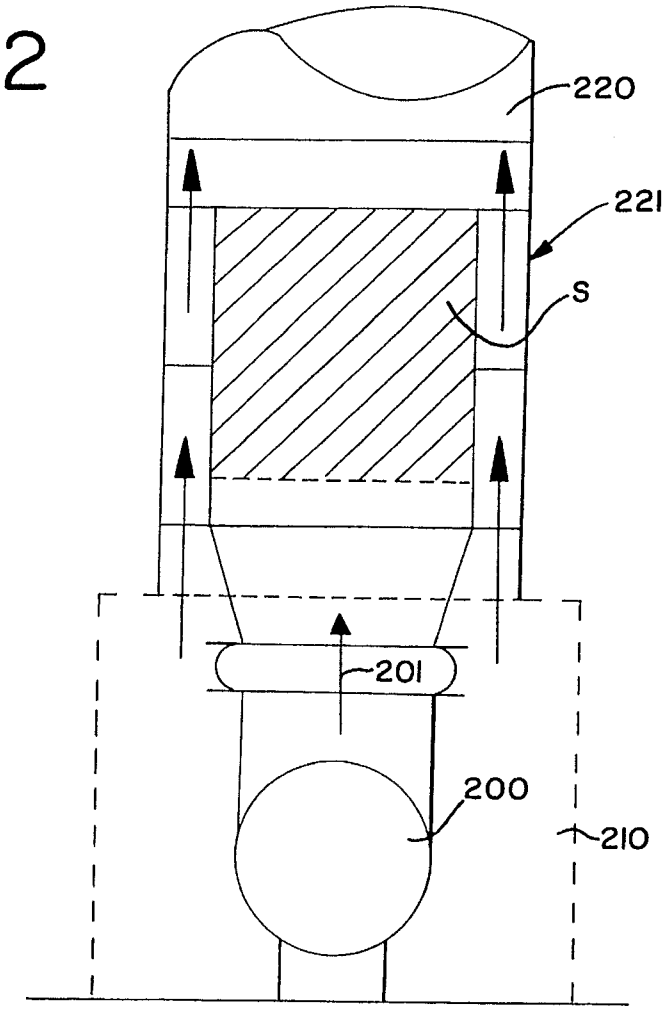
FIG. 2 is a schematic diagram of a simple turbine/generator installation having a vertical discharge with convective enclosure cooling.
Figure 1:
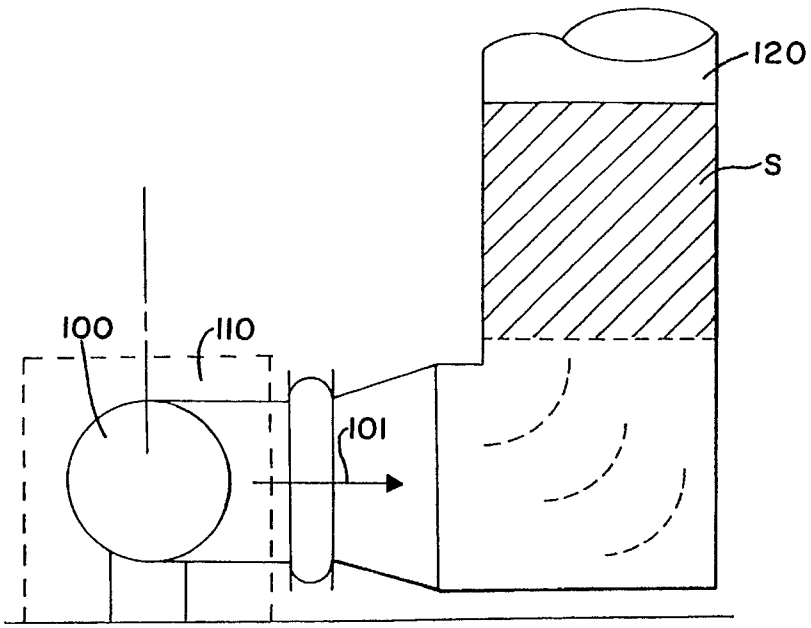
FIG. 1 is a schematic diagram of a simple turbine/generator installation having a horizontal discharge.
Figure 3:
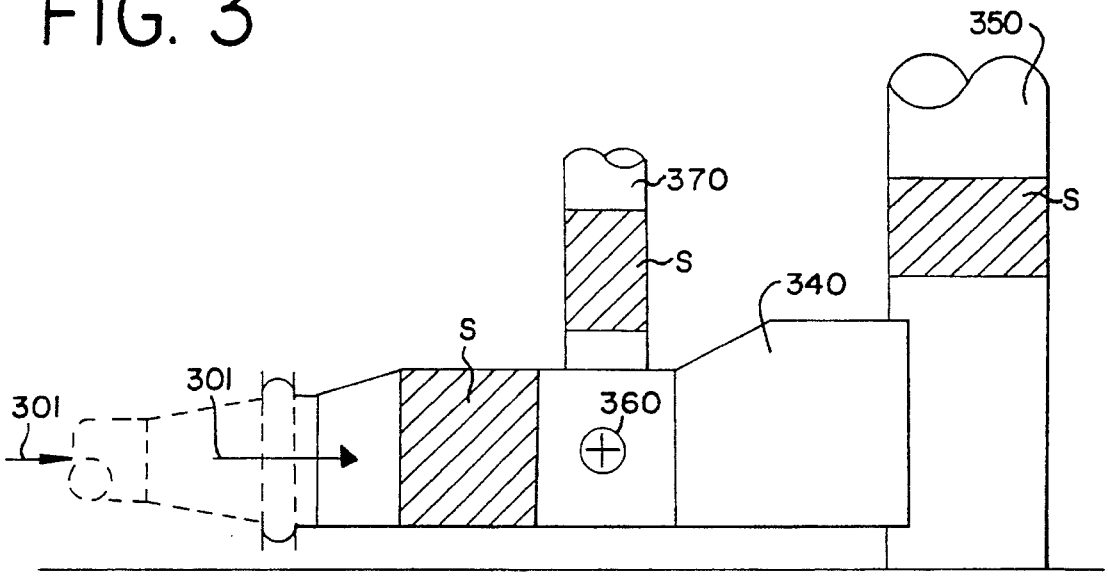
FIG. 3 is a schematic diagram of a combined cycle turbine/generator installation having an optional diverter and a by-pass stack.

To better understand the assembly of the present invention and its uses, several schematic diagrams are shown in FIGS. 1–3. Combustion turbine/generator installations are typically either simple cycle or combined cycle. A simple cycle installation, shown in FIGS. 1 and 2, has a turbine only and does not have a system for recovering heat. Such systems include a combustion turbine which drives a generator. The turbine/generator 100,200 is housed in an enclosure 110,210 and the exhaust 101,201 is passed to the atmosphere via a stack 120,220. In a simple cycle horizontal system, the stack 120 is spaced horizontally from the turbine/generator 100. In a simple cycle vertical system, the stack 220 is spaced vertically from the turbine/generator 200. As shown in FIG. 2, an outer wall 221 may be used with the stack 220 on units with convective enclosure cooling.

In the combined cycle configuration, shown in FIG. 3, the thermal energy is extracted from the hot exhaust 301 of the combustion turbine (not shown). This is usually accomplished by a heat recovery steam generator (HRSG) or boiler 340, which supplies steam to a steam turbine/generator. A primary main stack 350 is used in conjunction with the boiler 340. The system also incorporates a flow diverter valve 360 between the combustion turbine/generator and the boiler 340. The diverter valve directs the combustion turbine/generator exhaust 301 from the boiler 340 to a by-pass or relief stack 370.

Silencer assemblies S can be positioned between the combustion turbine/generators and their respective exhaust stacks to the atmosphere, between the combustion turbine/generators and the boilers, between the boilers and their respective stacks, and in the stacks. While not shown, a silencer assembly S may also be positioned between the flow diverter valve 360 and the heat recovery steam generator 340.

In most systems, the design criteria and constraints are given. For example, the temperature of the exhaust, the size of the equipments' input and output openings and the longitudinal spacing allotted are preexisting site conditions or predesigned. With these constraints known and the desired attenuation and pressure losses specified, the assembly is constructed.

Figure 4:
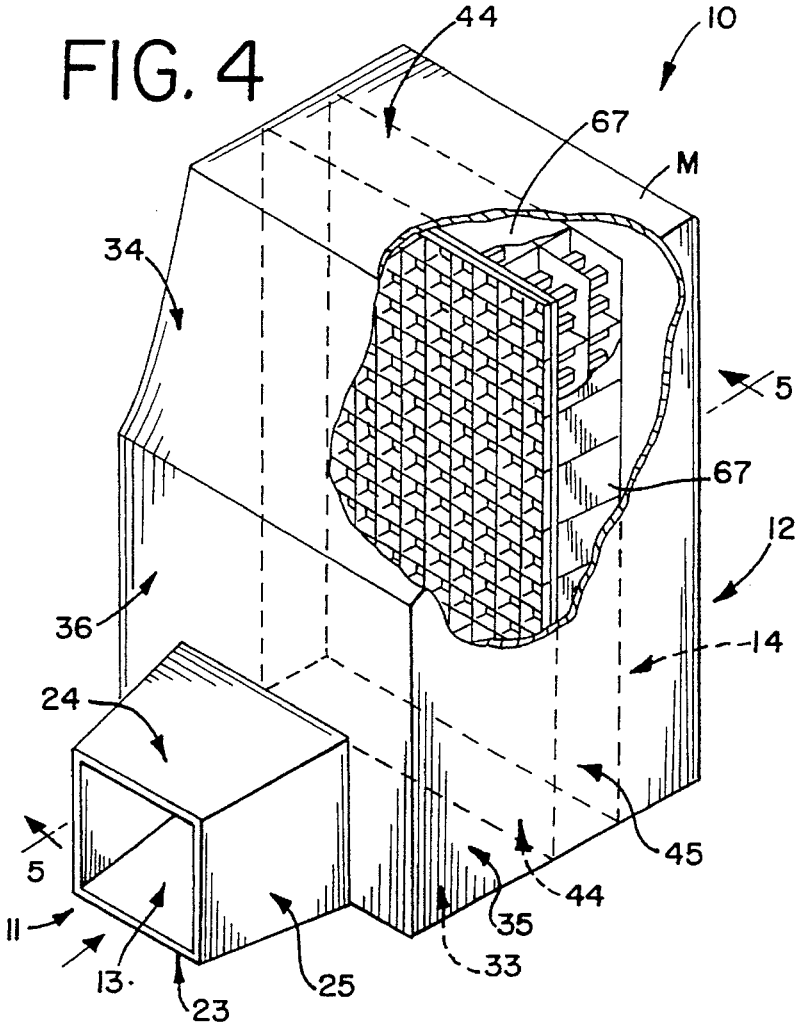
FIG. 4 is a top perspective view, with a section broken away, of the silencing assembly made in accordance with the teachings of the present invention.

Turning to FIG. 4, the silencer assembly, designated generally by the reference number 10, is shown. The silencer assembly 10 has a front end 11 and a rear end 12. The front end 11 has a primary assembly inlet 13 that is connected by known conventional means to the outlet for exhaust gas (not shown), such as the output of a turbine engine of the type used in power plants. Typically, the output is connected to an adapter, designated generally A1. At the rear end 12 of the silencer assembly 10 there is a primary assembly outlet 14 that is connected, again by conventional means, to an inlet of a piece of machinery (not shown), often a boiler or stack in a power plant, via a conventional adapter A2. It is these sizes of the adapters A1,A2 that are often preexisting or predesigned.

The assembly comprises a plurality of external walls that form two primary sections or chambers. The first section is for expanding the cross sectional area of the assembly and the second section is for silencing the flowing exhaust. In the embodiment illustrated, there are three sections or chambers 20,30,40. The first two sections, or chambers 20,30, are expansion areas for the gas and the third section, or chamber 40, houses a plurality of stacked acoustical modules 60.

Figure 5:
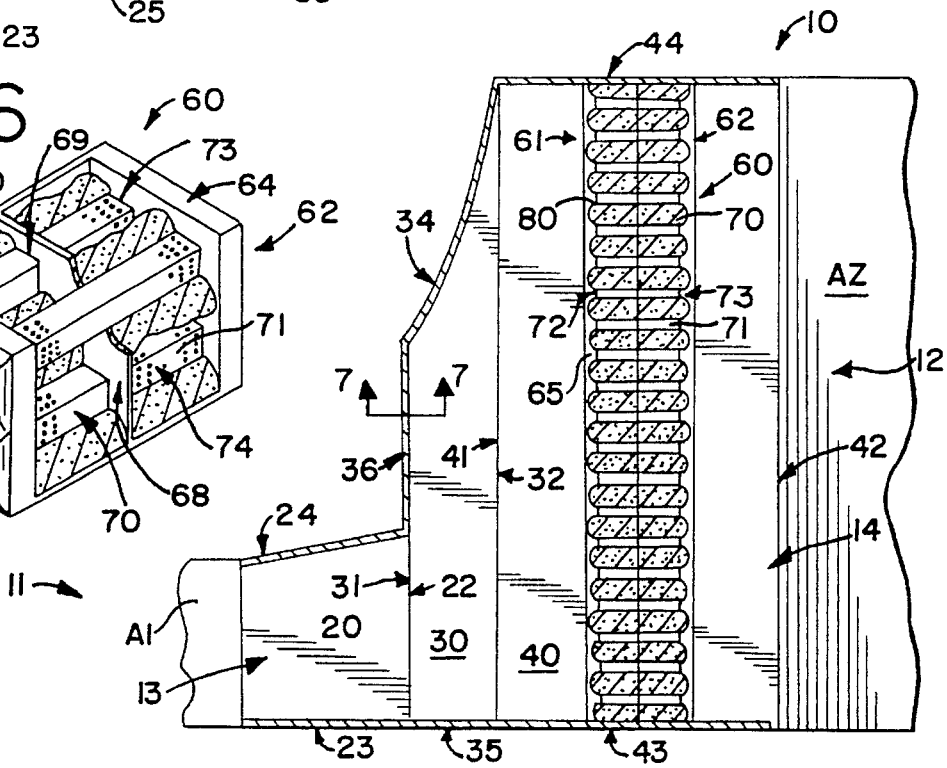
FIG. 5 is a side sectional view of the silencing assembly along line 5—5 in FIG. 4.

Turning to the first section 20, it includes an primary assembly inlet 13 at the front end 11 and an outlet 22 (FIG. 5) rearwardly thereof. It has a bottom wall 23, a top wall 24, and opposed side walls 25. As shown in FIGS. 4 and 5, the top wall 24 is inclined or tapered upwardly and outwardly so the area of the primary assembly inlet 13 is smaller than the area of the outlet 22. Similarly, the side walls 25 may also taper outwardly. As a result, the first chamber 20 adjacent the primary assembly inlet 13 has an expanding cross sectional area along its length.

The second section, or chamber, 30 is positioned adjacent the first section 20, and it, too, has an expanding cross sectional area along the length thereof. This second chamber 30 includes an inlet 31, which is also the outlet 22 for the first section 20, at its front end and an outlet 32 rearwardly thereof. It similarly has a bottom wall 33, a top wall 34, a front wall 36, and opposed side walls 35. As shown again in FIGS. 4 and 5, the front wall 36 adjacent the outlet 22 of the first section 20 is substantially vertical. And, the top wall 34 is tapered upwardly and outwardly in an arcuate manner. The area of the inlet 31 is less than the area of the outlet 32. Specifically, the second chamber 30 adjacent the inlet 31 thereof has an expanding cross sectional area along its length.

As noted previously, the output criteria or goals regarding the size of the area available for the equipment, the attenuation of sound desired and pressure loss permitted will often dictate the specific sizing of the equipment.

Figure 8:
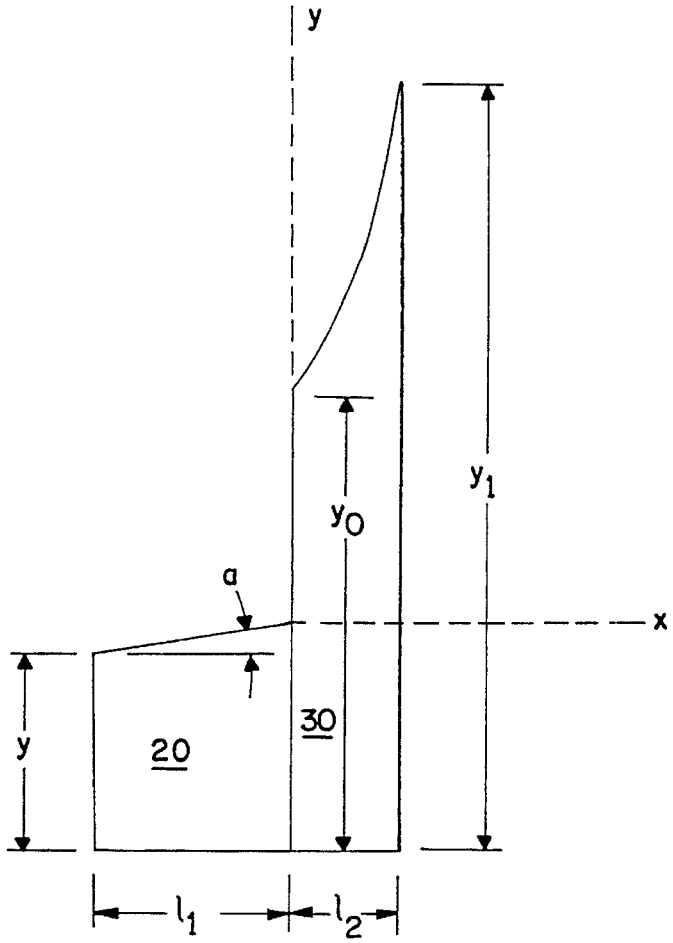

In the embodiment shown, the sizing was calculated as follows (with reference to FIG. 8):

y=height of first section 20 at its inlet 13

$y_0$=height of second section 30 at its inlet 31

$y_1$=height of second section 30 at its outlet 32

$l_1$=length of first section 20 between its inlet 13 and outlet 22

$l_2$=length of second section 30 between its inlet 31 and outlet 32 a=the angle of the taper of the first section 20 from its inlet 13

$D_H$=the hydraulic diameter

The following calculations were used to establish the sizing:

EQUATION FOR CURVE FORMATION/DEVELOPMENT $$y=\frac{y_1}{\sqrt[4]{1+\left[\left(\frac{y_1}{y_0}\right)^4-1\right]\frac{x}{l_2}}}$$

$$y=\frac{y_1}{\sqrt{1+\left[\left(\frac{y_1}{y_0}\right)^2-1\right]\frac{x}{l_2}}}$$

EQUATION OF ANGLE OF INLET $$tg\,\frac{a}{2}=\frac{(\sqrt{n}-1)\,D_H}{2\,l_1}$$

$$n=\frac{y_o}{y}$$

The third section, or chamber, 40 is positioned adjacent the second section 30; it is generally rectangular, having an inlet 41, which is also the outlet 32 for the second section 30, at its front end, and an outlet 42 (primary outlet for assembly) rearwardly thereof. It, too, has opposed side walls 45, a top wall 44, and a bottom wall 43, which is coplaner with the bottom walls 23,33 of the first section and the second section. While the top, side and bottom walls 44,45,43 form a generally rectangular, uniform channel, other channel configurations may be incorporated. For example, it is common to use a round configuration. The area of the inlet 41 is generally the same as the area of the outlet 42.

With the above construction, the cross sectional area of the inlet 13 of the first section 20 is less than the cross sectional area of the inlet 31 of the second section 30, which, in turn, is less than the cross sectional area of the inlet 41 of the third section 40.

The third section 40 includes at least one transversing bank comprised of a plurality of parallel, box-like acoustical modules 60 disposed therein between the inlet 41 and outlet 42. The bank, or wall, of modules 60 extend entirely from side wall 45 to side wall 45 and from top wall 44 to bottom wall 43. Thus, any exhaust/gas passing through the third chamber 40, will pass through the wall of modules 60. While not shown, more than one bank of modules may be utilized. A second bank and additional banks may be positioned spaced down stream from the first bank shown. In such multiple stage muffling systems or attenuation systems, the additional banks are positioned parallel to the first bank.

Each acoustical module has a front end 61 and a rear end 62 and a plurality of parallel, internal channel members 70 therein. The internal channel members 70 have generally uniform cross sections formed by side walls 71 (while shown rectangular in configuration, may also be circular, etc.). Each channel member 70 includes a front opening 72 toward the front end 61 of the module 60 and a rear opening 73 towards the rear end 62 of the module. The internal channel members 70 have a plurality of small perforations 74 therein. All of the channels 70 in the module 60 are surrounded by an acoustical media 80. The small perforations 74 in the channel members 70 are sized to prevent the acoustical media 80 from being sucked therethrough into the channel member and boiler and provide attenuation to allow sound energy to contact the acoustical media.

Figure 6:
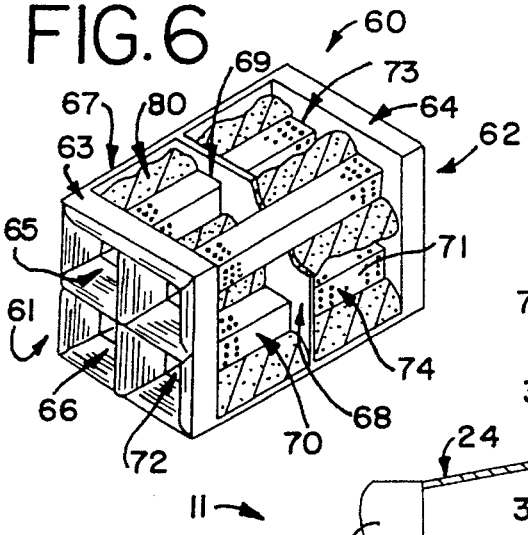
FIG. 6 is a broken out detail of an acoustical module made in accordance with the teachings of the present invention.

As shown in detail in FIG. 6, framing members 63,64 are positioned at each end 61,62 of the module 60 to hold the internal channel members in place and to give structural support to each module. The front framing member 63 is connected to the front openings 72 of the internal channel members 70 and the rear framing member 64 is connected to the rear openings 73 of the internal channel members. The framing members 63,64 have a mouth 65 adjacent each opening 72,73 of the internal channel members 70 with each mouth having a bevelled throat 66 tapering (arcuately) inwardly towards the channel member and the channel member openings.

In the embodiment shown, the modules 60 are rectangular with square ends 61,62 and four channels 70 therein. The framing members 63,64 are square and have four mouths 65 therein. Each module 60 has four encasing side walls 67 (FIG. 4) and an internal intermediate support wall 68, for structure support and further muffling, with openings 69 therein for the internal channel members 70.

The acoustical medium 80 are blankets. Specifically, each blanket comprises a glass fiber batt and an encapsulating glass fiber fabric cover or cloth. In systems where very high gas exhaust temperatures are reached, the batts may be encased in steel screening, or a metal mesh. With this construction, the blankets can be pre-cut and constructed prior to assembling the device. The blankets can then be arranged in each module so they fill the void space within the module around the internal channel members.

Figure 7:
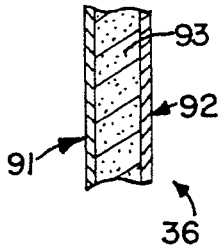
FIG. 7 is a partial sectional view of the external wall of the silencing assembly along line 7—7 in FIG. 5; and, FIG. 8 is a geometric representation of the first two chambers or expansion sections of the assembly.

As shown in the detail of FIG. 4, the first expansion chamber 20, the second expansion chamber 30 and the silencing chamber 40 have external walls. For further sound attenuation and in high temperature conditions, the external walls are comprised of a solid outer casing 91 and an internal heat shield liner 92 with an acoustical media 93 disposed therebetween. (FIG. 7).

As a result of the design, exhaust from the engine flows into the inlet 13 of the first expansion chamber 20 and expands, reducing the pressure thereof, as it flows therethrough into the second expansion chamber 30. The gas immediately expands upon entering the second chamber and passes through the second chamber 30 and expands still further, which further reduces the pressure thereof, and passes into the third silencing chamber 40. The gas passes through the wall comprised of acoustical modules 60 and out the outlet 14 towards the inlet for the boiler, if a boiler is used.

As to materials, the solid outer casing 91 of the external walls and the four encasing side walls 67 of the acoustical modules 60 may be made of stainless or carbon steel, the internal heat shield liner 92 of external walls may be made of stainless steel, and the internal channel members 70 of the acoustical modules 60 and the framing members 63,64, the internal intermediate support wall 68 and the side walls 67 of the acoustical modules 60 may be made of stainless steel, galvanized steel or carbon steel in low temperature conditions. Both the acoustical media 93 of external walls and the acoustical media 80 of the acoustical modules 60 may be constructed of fiberglass, mineral wool, mineral fiber and ceramic fiber insulation.

As to specific examples, a system was designed according to the equations previously noted. The length of this assembly was 42 feet, with an inlet width of 13 feet, an inlet height of 13 feet, an outlet width of 30 feet and an outlet height of 50 feet. The hot air temperature was estimated to be 1150° F. and the ambient air temperature was estimated to be 70° F. The external casing was designed for 140° F. with 0° ft./min. cooling air velocity over the cold casing. The design pressure was 20" W.G. (Inches Water Gauge).

The following was the system acoustical input spectrum:

| Frequency (HZ) | 63 | 125 | 250 | 500 | 1K | 2K | 4K | 8K |
|---|---|---|---|---|---|---|---|---|
| Decibels (dB) | 149 | 153 | 140 | 137 | 134 | 137 | 135 | 134 |

The overall sound was 144 dBA.

The following was the designed system acoustic dynamic insertion loss of the system:

| Frequency (HZ) | 63 | 125 | 250 | 500 | 1K | 2K | 4K | 8K |
|---|---|---|---|---|---|---|---|---|
| Attenuation (dB) | 6 | 12 | 19 | 27 | 30 | 27 | 17 | 10 |

The change in pressure through the system was designed to be 2.3" W.G. which is less than conventional systems (4.3" W.G.).

While specific embodiments have been illustrated and described, numerous modifications are possible without significantly departing from the spirit of the invention, and the scope of protection is only limited by the scope of the accompanying claims.

I claim:

1. A silencer assembly interposed between the outlet of a first component and the inlet of a second component comprising:

external side walls with an inlet with a first cross sectional area connected to the outlet of the first component and an outlet connected to the inlet of the second component;

a first section adjacent said inlet having an expanding cross sectional area along the length thereof;

a second section adjacent said first section also having an expanding cross sectional area along the length thereof; and, a third section adjacent at one end to said second section and adjacent at another end to said outlet, said third section including at least one transversing bank of a plurality of parallel acoustical modules disposed therein between said two ends, each said acoustical module having a front end and a rear end and at least one internal channel member therein, said internal channel member having a plurality of perforations therein and a front opening at said front end of said module and a rear opening at said rear end of said module and said internal channel member being surrounded by an acoustical media.

2. The silencer assembly of claim 1 wherein each said acoustical module further includes a plurality of parallel internal channel members therein, each said internal channel member having a plurality of perforations therein and a front opening at said front end of said module and a rear opening at said rear end of said module and each said internal channel member being surrounded by an acoustical media.

3. The silencer assembly of claim 2 wherein said front openings of said internal channel members are connected to a front framing member having a mouth adjacent each said internal channel member with a throat tapering towards said internal channel member and said rear openings of said internal channel members are connected to a rear framing member having a mouth adjacent each said internal channel member with a throat tapering towards said internal channel member.

4. The silencer assembly of claim 3 wherein each said acoustical module has encasing side walls and an internal intermediate support wall with openings therein for said internal channel members.

5. The silencer assembly of claim 1 wherein said external side walls comprise a solid outer casing and an internal heat shield liner with an acoustical media disposed therebetween.

6. A silencer assembly interposed between the outlet of a first component and the inlet of a second component comprising:

an expansion section having two ends, an inlet at one end connected to the outlet of the first component and an outlet at the other end connected to a silencing section, said expansion section tapering outwardly along the length thereof from said inlet to said outlet such that the area of said outlet is greater than the area of said inlet; and, a silencing section having two ends, said inlet at one end being connected to said outlet of said expansion section and an outlet at the other end connected to the inlet of the second component, said silencing section including at least one transversing bank of a plurality of parallel acoustical modules disposed therein between said two ends.

7. The silencer assembly of claim 6 wherein both said expansion section and said silencing section have external walls comprising a solid outer casing and an internal heat shield liner with an acoustical media disposed therebetween.

8. A silencer assembly interposed between the outlet of an engine and the inlet of a boiler comprising:

a first chamber having an inlet connected to the outlet of the engine for receiving gas from the engine adapted for permitting the flow of said gas to an inlet of a second chamber;

a second chamber, adjacent said first chamber, adapted for receiving said gas from said first chamber and for permitting the flow of said gas to an inlet of a third chamber, said first chamber being configured along the length thereof such that the surface area of said inlet of said first chamber is less than the surface of said inlet of said second chamber and said second chamber being configured along the length thereof such that the area of said inlet of said second chamber is less than the area of said inlet of said third chamber; and, a third chamber adapted for receiving said gas from said second chamber and for permitting the flow of said gas to the inlet of the boiler, said third chamber including at least one transversing bank of a plurality of acoustical modules disposed therein, each said acoustical module having a front end and a rear end and at least one internal channel member therein, said internal channel member having a plurality of perforations therein and a front opening at said front end of said module and a rear opening at said rear end of said module and said internal channel member being surrounded by an acoustical media.

9. The silencer assembly of claim 8 wherein each said acoustical module further includes a plurality of parallel internal channel members therein, each said internal channel members having a plurality of perforations therein and a front opening at said front end of said module and a rear opening at said rear end of said module and each said internal channel members being surrounded by an acoustical media.

10. The silencer assembly of claim 9 wherein said front openings of said internal channel members are connected to a front framing member having a mouth adjacent each said internal channel member with a throat tapering towards said internal channel member.

11. The silencer assembly of claim 10 wherein said rear openings of said internal channel members are connected to a rear framing member having a mouth adjacent each said internal channel member with a throat tapering towards said internal channel.

12. The silencer assembly of claim 11 wherein each said acoustical module has encasing side walls and an internal intermediate support wall with openings therein for said internal channel members.

13. The silencer assembly of claim 12 wherein said acoustical media are blankets.

14. The silencer assembly of claim 13 wherein said blankets include a fiberglass batt and an encapsulating fiberglass fabric cover.

15. The silencer assembly of claim 8 wherein said first chamber and said second chamber have external walls comprising a solid outer casing and an internal heat shield liner with an acoustical media disposed therebetween.

16. The silencer assembly of claim 15 wherein said third chamber has external walls comprising a solid outer casing and an internal heat shield liner with an acoustical media disposed therebetween.

* * * * *